US007781989B2

(12) United States Patent
Miyazaki

(10) Patent No.: US 7,781,989 B2
(45) Date of Patent: Aug. 24, 2010

(54) DISCHARGE LAMP DRIVE CONTROL CIRCUIT

(75) Inventor: Hiroyuki Miyazaki, Tokyo (JP)

(73) Assignee: Sumida Corporation, Tokyo (JP)

( * ) Notice: Subject to any disclaimer, the term of this patent is extended or adjusted under 35 U.S.C. 154(b) by 370 days.

(21) Appl. No.: 12/043,325

(22) Filed: Mar. 6, 2008

(65) Prior Publication Data

US 2008/0185979 A1 Aug. 7, 2008

Related U.S. Application Data

(63) Continuation of application No. PCT/JP2006/317227, filed on Aug. 31, 2006.

(30) Foreign Application Priority Data

Sep. 7, 2005 (JP) ..... 2005-259548

(51) Int. Cl.
*G05F 1/00* (2006.01)

(52) U.S. Cl. ..... 315/308; 315/291; 315/224; 315/274; 315/312

(58) Field of Classification Search ..... 315/291, 315/307–311, 224, 225, 274–297
See application file for complete search history.

(56) References Cited

U.S. PATENT DOCUMENTS

| | | | | |
|---|---|---|---|---|
| 6,420,839 | B1 | 7/2002 | Chiang et al. | |
| 2005/0286201 | A1* | 12/2005 | Jacobs et al. | 361/220 |
| 2009/0273285 | A1* | 11/2009 | Lin et al. | 315/121 |

FOREIGN PATENT DOCUMENTS

| | | |
|---|---|---|
| JP | 06-283284 | 10/1994 |
| JP | 06-338397 | 12/1994 |
| JP | 08-275543 | 10/1996 |
| JP | 09283297 | 10/1997 |
| JP | 11-273884 | 10/1999 |
| JP | 2000-166245 | 6/2000 |
| JP | 2001-035679 | 2/2001 |
| JP | 2003-059682 | 2/2003 |
| JP | 2004-207063 | 7/2004 |
| TW | 481969 | 4/2002 |

OTHER PUBLICATIONS

International Search Report for PCT/JP2006/317227 issued by the Japanese Patent Office Nov. 2006.
Japanese Office Action dated May 21, 2010 for Japanese Patent Application No. 2005-25948, 2 pgs. (In Japanese).

* cited by examiner

*Primary Examiner*—Tuyet Vo
(74) *Attorney, Agent, or Firm*—Coats & Bennett, P.L.L.C.

(57) ABSTRACT

A single comparison circuit detects load open circuit abnormality and load short circuit abnormality of a discharge lamp operating at a high-frequency driving voltage, with a small number of circuit elements. A discharge lamp drive control circuit includes an inverter control circuit, a positive change voltage detecting circuit which detects a positive change of voltage occurring in the secondary coil of a driving transformer, a negative change voltage detecting circuit which detects a negative change of voltage occurring in the secondary coil of the driving transformer, and the comparison circuit connected to the inverter control circuit. The outputs from the positive and negative change voltage detecting circuits are added to generate an added output, and the added output is supplied to the comparison circuit and compared with a reference voltage. When an abnormal operation occurs, the comparison circuit supplies an abnormal operation control signal to the inverter control circuit.

8 Claims, 6 Drawing Sheets

DISCHARGE LAMP DRIVE CONTROL CIRCUIT

This application is a continuation of PCT/JP2006/317227, filed Aug. 31, 2006, and claims the benefit of Japanese Patent Application No. 2005-259548, filed Sep. 7, 2005, both of which are hereby incorporated by reference herein in their entirety.

TECHNICAL FIELD

The present invention relates to a discharge lamp drive control circuit that controls lighting of a discharge lamp such as a fluorescent lamp and, more particularly, to a discharge lamp drive control circuit capable of controlling abnormal operations such as load open circuit abnormality and load short circuit abnormality with a small number of circuit elements.

BACKGROUND ARTS

As is well known, a discharge lamp such as a fluorescent lamp emits light when driven by a high-frequency driving voltage generated by an inverter. Discharge lamps of this type are of course used for illumination, and are also used as the light sources of backlights of many liquid crystal display devices in recent years. A discharge lamp is connected, via a connector, to the output terminal on the secondary coil side of a driving transformer formed on the output side of an inverter included in a discharge lamp drive control circuit.

In this case, however, the discharge lamp may not be connected to a connection terminal connected to the output terminal on the secondary coil side of the driving transformer because the discharge lamp and connector are not well connected, or the output terminal on the secondary coil side of the driving transformer may be shortcircuited for some reason. In a case like this, a high voltage of the driving transformer causes discharge, and this may lead to smoke, fire, or the like. In addition, if the discharge lamp itself is broken or old, the output terminal on the secondary coil side of the driving transformer connected to the connector causes a load open circuit state or load short circuit state, and this increases the possibility of smoke, fire, or the like described above.

Accordingly, in order to prevent, e.g., the generation of heat by an abnormal operation such as the load open circuit state or load short circuit state, the conventional discharge lamp drive control circuit has an abnormal operation detecting circuit that detects the open circuit state or short circuit state of the output terminal on the secondary coil side of the driving transformer of the inverter, and stops the operation of the inverter.

The conventionally used abnormal operation detecting circuit has an arrangement in which two comparison circuits are formed to detect load open circuit abnormality and load short circuit abnormality, and an inverter control circuit is controlled by the outputs from these two comparison circuits, thereby stopping the operation of the inverter. In a multi-lamp-type discharge lamp drive control circuit for a plurality of discharge lamps, abnormal operations are generally detected by forming two comparison circuits for detecting load open circuit abnormality and load short circuit abnormality for each discharge lamp.

SUMMARY OF THE INVENTION

Problems that the Invention is to Solve

Unfortunately, the discharge lamp drive control circuit including the conventional abnormal operation detecting circuit described above requires two comparison circuits for one discharge lamp. Accordingly, a multi-lamp-type discharge lamp drive control circuit for controlling N discharge lamps requires 2N comparison circuits to detect abnormal operations, and this is disadvantageous in cost because the number of parts of the discharge lamp drive control circuit increases.

Means of Solving the Problems

A discharge lamp drive control circuit according to the present invention is a discharge lamp drive control circuit which turns on a discharge lamp by applying, to the discharge lamp, a high-frequency driving voltage generated in a secondary coil of a driving transformer forming an inverter, comprising an inverter control circuit, a positive change voltage detecting circuit which detects a negative change of voltage generated in the secondary coil of the driving transformer, a negative change voltage detecting circuit which detects a negative change of voltage generated in the secondary coil of the driving transformer, and a comparison circuit connected to the inverter control circuit, wherein outputs from the positive change voltage detecting circuit and the negative change voltage detecting circuit are added to generate an added output, the added output is supplied to the comparison circuit and compared with a reference voltage, and the comparison circuit supplies an abnormal operation control signal to the inverter control circuit when an abnormal operation occurs.

Also, a discharge lamp drive control circuit according to the present invention is a multi-lamp-type discharge lamp drive control circuit which has a plurality of driving transformers forming an inverter, and turns on discharge lamps by applying, to the discharge lamps, high-frequency driving voltages generated in secondary coils of the driving transformers, comprising an inverter control circuit, a plurality of positive change voltage detecting circuits which detect positive changes of voltages generated in the secondary coils of the driving transformers, a plurality of negative change voltage detecting circuits which detect negative changes of voltages generated in the secondary coils of the driving transformers, and a comparison circuit connected to the inverter control circuit, wherein outputs from the negative change voltage detecting circuits are added via an OR circuit to outputs from the positive change voltage detecting circuits to generate an added output, the added output is supplied to the comparison circuit and compared with a reference voltage, and the comparison circuit supplies an abnormal operation control signal to the inverter control circuit when an abnormal operation occurs.

Furthermore, the discharge lamp drive control circuit of the present invention provides a discharge lamp drive control circuit in which a comparison circuit included in the inverter control circuit is used as the comparison circuit.

EFFECTS OF THE INVENTION

In the discharge lamp drive control circuit of the present invention, the single comparison circuit can detect both load short circuit abnormality and load open circuit abnormality as abnormal operations, so the discharge lamp drive control circuit can be configured with a small number of circuit elements. In addition, even in a discharge lamp drive control circuit for driving a plurality of discharge lamps, a single comparison circuit can detect abnormal operations such as load short circuit abnormality and load open circuit abnormality of the discharge lamps.

Accordingly, even a multi-lamp-type discharge lamp drive control circuit can be configured by a relatively small circuit scale. Furthermore, when a comparison circuit incorporated in an inverter control circuit is used as the comparison circuit, the discharge lamp drive control circuit can be implemented with a smaller number of circuit elements.

Other features and advantages of the present invention will become apparent from the following explanation taken in conjunction with the accompanying drawings. Note that the same reference numerals denote the same or similar parts in the accompanying drawings.

BRIEF DESCRIPTION OF DRAWINGS

The accompanying drawings are incorporated in the specification, constitute a part of the specification, illustrate embodiments of the present invention, and serve to explain the principles of the present invention together with the description of the embodiments.

EXPLANATION OF REFERENCE NUMERALS

Figure 1:
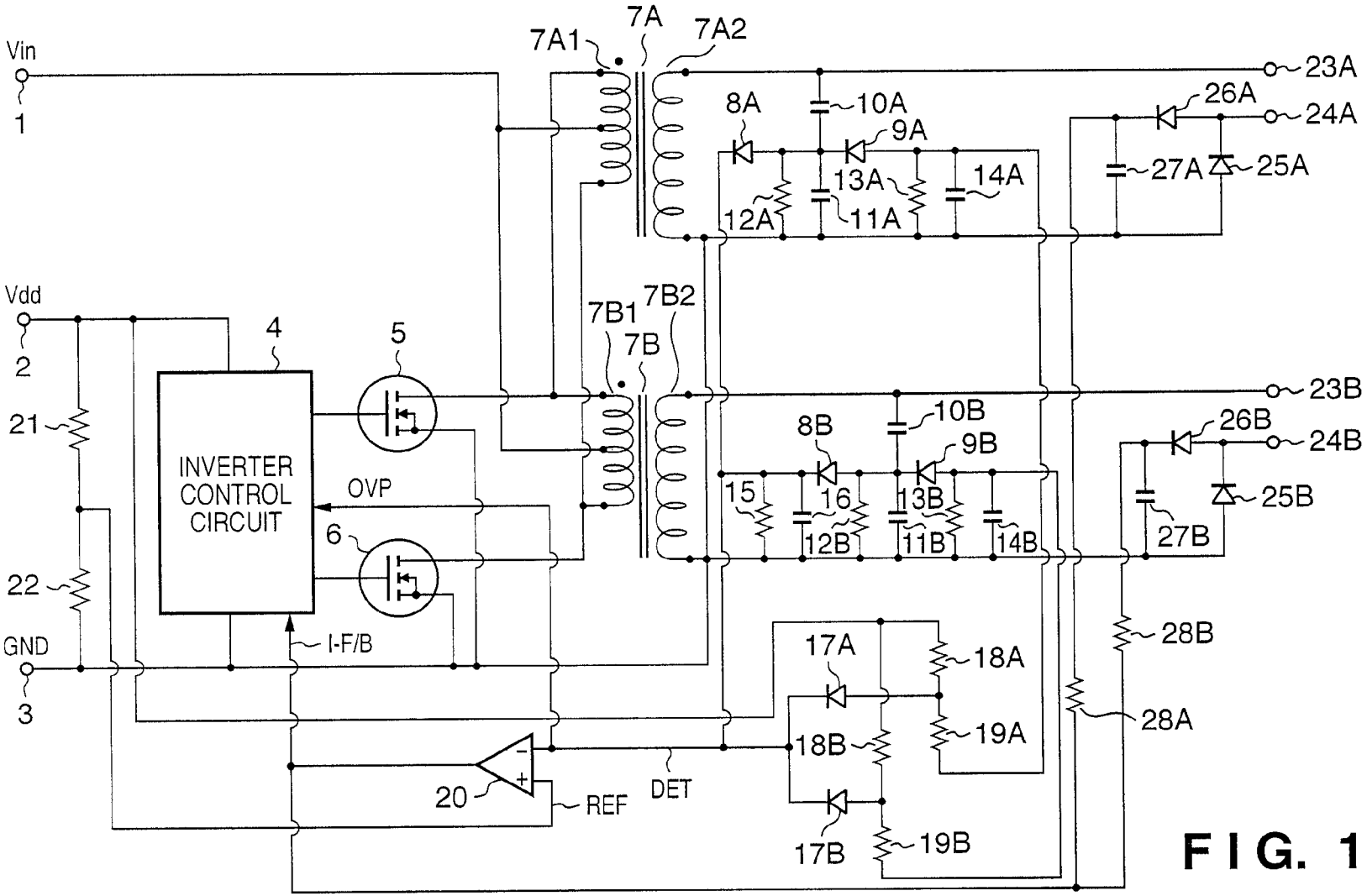
FIG. 1 is a circuit diagram of the first embodiment of a discharge lamp drive control circuit according to the present invention, and shows an example in which two discharge lamps are controlled.

4,33 . . . Inverter control circuit

5,6 . . . Switching transistor

34 . . . Switching circuit

7A, 7B, 35 . . . Driving transformer

8A, 8B, 41, 41A, 41B . . . Positive change voltage detecting diode

9A, 9B, 44, 44A, 44B . . . Negative change voltage detecting diode

20, 45 . . . Comparison circuit

100 . . . Inverter driving circuit

200 . . . Discharge lamp control circuit

DESCRIPTION OF THE PREFERRED EMBODIMENTS

First Embodiment

FIG. 1 shows the first embodiment of the present invention, and a discharge lamp drive control circuit shown in FIG. 1 is connected to two discharge lamps (not shown). In the discharge lamp drive control circuit shown in FIG. 1, an inverter comprising an inverter control circuit 4, a pair of switching transistors 5 and 6, and a pair of driving transformers 7A and 7B converts a DC power supply voltage Vin applied between terminals 1 and 3 into a high-frequency driving voltage. The converted high-frequency driving voltage is applied to a first discharge lamp (not shown) connected to a high voltage side output terminal 23A and low voltage side output terminal 24A, and a second discharge lamp (not shown) connected to a high voltage side output terminal 23B and low voltage side output terminal 24B, thereby driving the first and second discharge lamps.

Note that a ground voltage GND is applied to the terminal 3 as a ground terminal. Note also that a terminal 2 applies a DC operating voltage Vdd for operating the inverter control circuit 4, and the ground voltage GND is also applied to the inverter control circuit 4. The inverter control circuit 4 generates switching control signals for the pair of switching transistors 5 and 6. These switching control signals generated by the inverter control circuit 4 are supplied to the gate electrodes of N-type field effect transistors as the pair of switching transistors 5 and 6, and control electrical connections between the drain electrodes and source electrodes of the switching transistors 5 and 6. The source electrodes of the pair of switching transistors 5 and 6 are set at the ground voltage GND.

Paired input terminals of a primary coil 7A1 of the driving transformer 7A and paired input terminals of a primary coil 7B1 of the driving transformer 7B are connected in parallel, and connected to the drain electrodes of the paired switching transistors 5 and 6. On the other hand, the midpoint terminals of the primary coils 7A1 and 7B1 of the driving transformers 7A and 7B are connected together to the terminal 1 to receive the DC power supply voltage Vin.

The high voltage side of a secondary coil 7A2 of the driving transformer 7A is connected to the high voltage side output terminal 23A as described previously, but the low voltage side of the secondary coil 7A2 is set at the ground voltage GND. Likewise, the high voltage side of a secondary coil 7B2 of the driving transformer 7B is connected to the high voltage side output terminal 23B, but the low voltage side of the secondary coil 7B2 is set at the ground voltage GND.

Capacitors 10A and 11A for high voltage detection are connected in series between the high voltage side of the secondary coil 7A2 of the driving transformer 7A and the ground voltage GND. A resistor 12A is connected in parallel to the capacitor 11A, so the capacitor 11A may also be omitted depending on the conditions. The connection midpoint of the capacitors 10A and 11A for high voltage detection is connected to the anode electrode of a diode 8A that is comprised in a circuit for detecting the positive change of voltage at this midpoint. A positive change detection voltage obtained in the cathode electrode of the diode 8A is applied to the inverted input terminal of a comparison circuit 20.

Similarly, capacitors 10B and 11B for high voltage detection are connected in series between the high voltage side of the secondary coil 7B2 of the driving transformer 7B and the ground voltage GND. A resistor 12B is connected in parallel to the capacitor 11B, so the capacitor 11B may also be omitted depending on the conditions. The connection midpoint of the capacitors 10B and 11B for high voltage detection is connected to the anode electrode of a diode 8B that is comprised in a circuit for detecting the positive change of voltage at this midpoint. A positive change detection voltage obtained in the cathode electrode of the diode 8B is also similarly applied to the inverted input terminal of the comparison circuit 20. Note that a resistor 15 and capacitor 16 are connected in parallel between the connection point of the cathode electrodes of the diodes 8A and 8B and the ground voltage GND.

A reference voltage REF is applied to the non-inverted input terminal of the comparison circuit 20. The reference voltage REF is applied from the connection midpoint of a pair of resistors 21 and 22 inserted between the terminals 2 and 3. The comparison circuit 20 supplies the output to the I-F/B terminal of the inverter control circuit 4, thereby controlling the operations of the pair of switching transistors 5 and 6.

The connection midpoint of the capacitors 10A and 11A for high voltage detection is further connected to the cathode electrode of a diode 9A that is comprised in a circuit for detecting the negative change of voltage at this midpoint, and the anode electrode of the diode 9A is connected to the anode electrode of a diode 17A via the connection midpoint of resistors 18A and 19A. The cathode electrode of the diode 17A is connected to the inverted input terminal of the comparison circuit 20. Accordingly, a negative change detection voltage obtained in the anode electrode of the diode 9A is added to the positive change detection voltage via the resistor 19A and diode 17A, and the added voltage is applied as a detection signal DET to the inverted input terminal of the comparison circuit 20. The detection signal DET is also applied to the OVP terminal of the inverter control circuit 4. The DC operating voltage Vdd applied to the terminal 2 is applied to the resistor 18A. A parallel circuit of a resistor 13A and capacitor 14A is connected between the anode electrode of the diode 9A and the ground voltage GND.

Likewise, the connection midpoint of the capacitors 10B and 11B for high voltage detection is further connected to the cathode electrode of a diode 9B that is comprised in a circuit for detecting the negative change of voltage at this midpoint, and the anode electrode of the diode 9B is connected to the anode electrode of a diode 17B via the connection midpoint of resistors 18B and 19B. The cathode electrode of the diode 17B is connected to the inverted input terminal of the comparison circuit 20. Therefore, a negative change detection voltage obtained in the anode electrode of the diode 9B is added to the positive change detection voltage via the resistor 19B and diode 17B, and the added voltage is applied as the detection signal DET to the inverted input terminal of the comparison circuit 20. The DC operating voltage Vdd applied to the terminal 2 is applied to the resistor 18A. A parallel circuit of a resistor 13B and capacitor 14B is connected between the anode electrode of the diode 9B and the ground voltage GND.

The low voltage side output terminal 24A is connected to the cathode electrode of a diode 25A and the anode electrode of a diode 26A. The cathode electrode of the diode 26A is added via a resistor 28A to the output from the comparison circuit 20, and the added output is applied to the I-F/B terminal of the inverter control circuit 4. A capacitor 27A is connected between the cathode electrode of the diode 26A and the ground voltage GND. The anode electrode of the diode 25A is set at the ground voltage GND.

Analogously, the low voltage side output terminal 24B is connected to the cathode electrode of a diode 25B and the anode electrode of a diode 26B. The cathode electrode of the diode 26B is added via a resistor 28B to the output from the comparison circuit 20, and the added output is applied to the I-F/B terminal of the inverter control circuit 4. A capacitor 27B is connected between the cathode electrode of the diode 26B and the ground voltage GND. The anode electrode of the diode 25B is set at the ground voltage GND.

The operation of the first embodiment of the present invention shown in FIG. 1 will be explained below. In a normal operation, the secondary coils 7A2 and 7B2 of the driving transformers 7A and 7B generate a high-frequency driving voltage for discharge lamp driving of about 1,000 Vrms at, for example, 50 KHz. This high-frequency driving voltage is applied to the first and second discharge lamps (not shown) connected via the high voltage side output terminals 23A and 23B, thereby turning on these discharge lamps. The low voltage sides of the discharge lamps are connected to the low voltage output terminals 24A and 24B. Voltages depending on electric currents flowing through the discharge lamps are applied via the diode 26A and resistor 28A, or diode 26B and resistor 28B to the I-F/B terminal of the inverter control circuit 4, thereby performing control such that the electric current flowing through each discharge lamp is constant.

In this normal operation, the reference voltage REF applied to the non-inverted input terminal of the comparison circuit 20 is, for example, about 1.2 V, whereas the detection signal DET of about 0.5 to 1 V is applied to the inverted input terminal of the comparison circuit 20.

If abnormality occurs in the first discharge lamp connected to the high voltage side output terminal 23A and low voltage side output terminal 24A, the detection signal DET applied to the inverting input terminal of the comparison circuit 20 rises and exceeds 1.2 V of the reference voltage REF. If load open circuit abnormality occurs, for example, the potential at the connection midpoint of the capacitors 10A and 11A for high voltage detection rises, and this potential is applied via the diode 8A to the inverted input terminal of the comparison circuit 20, thereby raising the voltage of the detection signal DET. On the other hand, if load short circuit abnormality occurs, it is no longer possible to detect the negative change detection voltage at the connection midpoint of the capacitors 10A and 11A for high voltage detection.

Accordingly, the electric current flowing through the resistor 13A in the normal operation does not flow any longer, and the anode potential of the diode 9A becomes the ground voltage. Consequently, the voltage at the connection midpoint of the resistors 18A and 19B rises, and this voltage is applied via the diode 17A to the inverted input terminal of the comparison circuit 20, thereby raising the voltage of the detection signal DET. This allows the single comparison circuit 20 to detect both load open circuit abnormality and load short circuit abnormality. In accordance with the comparison result, the comparison circuit 20 applies an abnormal operation control signal to the I-F/B terminal of the inverter control circuit 4, and stops the operation of the inverter by a stop circuit of the inverter control circuit 4. The operation is exactly the same as described above even when abnormality occurs in the second discharge lamp connected to the high voltage side output terminal 23B and low voltage side output terminal 24B, so a repetitive explanation will be omitted.

Figure 2A:
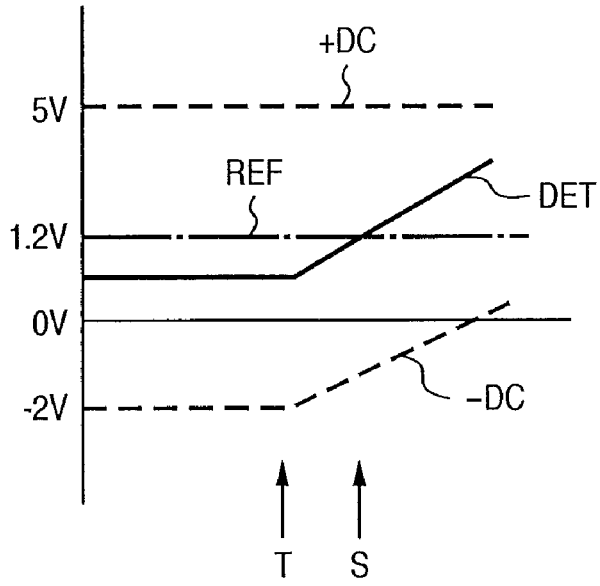
FIG. 2A is a timing chart for explaining the operation of the discharge lamp drive control circuit shown in FIG. 1, and shows waveforms for explaining load short circuit abnormality.
Figure 2B:
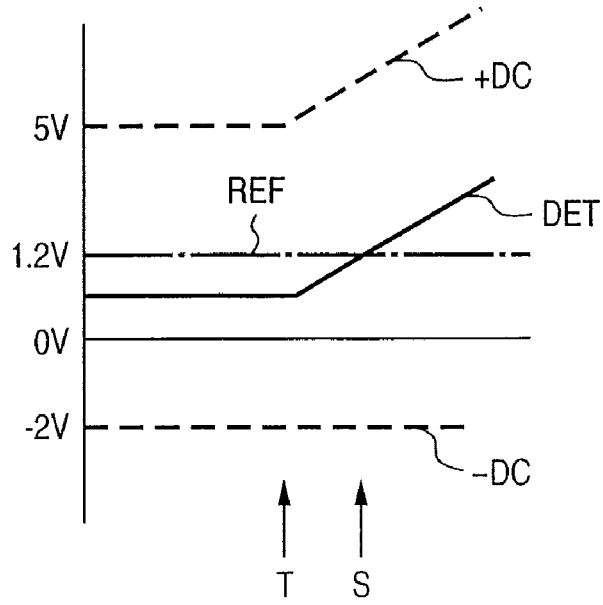
FIG. 2B similarly shows waveforms for explaining load open circuit abnormality.

FIGS. 2A and 2B are timing charts for explaining the operation of the discharge lamp drive control circuit shown in FIG. 1. FIG. 2A shows the case where load short circuit abnormality occurs, and FIG. 2B shows the case where load open circuit abnormality occurs. Let +DC be the positive change detection midpoint voltage and −DC be the negative change detection midpoint voltage of the high voltage detecting capacitors 10A and 10B, and assume that in the normal operation, as shown in FIG. 2A, the positive change detection midpoint voltage +DC is, for example, 5 V, the negative change detection midpoint voltage −DC is, for example, −2 V, and the reference voltage REF is, for example, 1.2 V. Accordingly, the detection signal DET is, for example, 0.7 V that is the added voltage of the positive change detection midpoint voltage +DC and negative change detection midpoint voltage −DC.

If load short circuit abnormality occurs in the first discharge lamp at time T, the negative change detection midpoint voltage −DC rises, so the voltage of the detection signal DET as an added signal also rises at the same time. The output from the comparison circuit 20 is reversed at time S at which the voltage of the detection signal DET exceeds the reference voltage REF, and this makes it possible to apply the abnormal operation control signal to the I-F/B terminal of the inverter control circuit 4. On the other hand, FIG. 2B shows the case where load open circuit abnormality occurs. That is, if load open circuit abnormality occurs at time T, the positive change detection midpoint voltage +DC rises, so the voltage of the detection signal DET as an added signal also rises at the same time. Accordingly, the output from the comparison circuit 20 is reversed at time S at which the voltage of the detection signal DET exceeds the reference voltage REF, and the abnormal operation control signal is applied to the I-F/B terminal of the inverter control circuit 4. The other circuit portion connected to the second discharge lamp operates in exactly the same manner as above, so a repetitive explanation will be omitted.

As described above, in the discharge lamp drive control circuit shown in FIG. 1, the load open circuit abnormality detection outputs from the two discharge lamps are supplied to the inverted input of the comparison circuit 20 by connecting the anodes of the diodes 8A and 8B. The load short circuit abnormality detection outputs are added to the load open circuit abnormality detection outputs by performing an OR operation by connecting the anodes of the diodes 17A and 17B, and the added output is supplied as the detection signal DET to the inverted input of the comparison circuit 20. This makes it possible to control the two types of load abnormal operations of the two discharge lamps. Even when driving three or more discharge lamps, it is possible, by adding a diode as an OR circuit, to allow the single comparison circuit 20 to detect load abnormal operations of the three or more discharge lamps, and stop driving if abnormality occurs.

Assume that a discharge lamp drive control circuit corresponding to four discharge lamps is configured using two discharge lamp drive control circuits shown in FIG. 1. Even in this case, the outputs from the individual detecting circuits are added, the added output is supplied to only one comparison circuit 20, and the output from the comparison circuit 20 is supplied to the individual inverter control circuits. This allows the single comparison circuit 20 to detect abnormal operations of the four discharge lamps.

The present invention is not limited to the first embodiment explained with reference to FIG. 1, and can include various modifications. For example, the present invention is applicable regardless of the load system (for example, a straight tube, U-shaped tube, or pseudo U-shaped tube), the output feedback system (for example, tube low voltage side current control or transformer low voltage side current control), or the inverter system (for example, a full bridge, half bridge, or push-pull).

The first embodiment shown in FIG. 1 is an embodiment using the comparison circuit 20 in addition to the inverter control circuit 4. Depending on the internal circuit configuration of the inverter control circuit 4, however, a comparison circuit arranged in the inverter control circuit 4 as an internal circuit of the I-F/B terminal of the inverter control circuit 4 may also be used as the comparison circuit 20.

Second Embodiment

Figure 3:
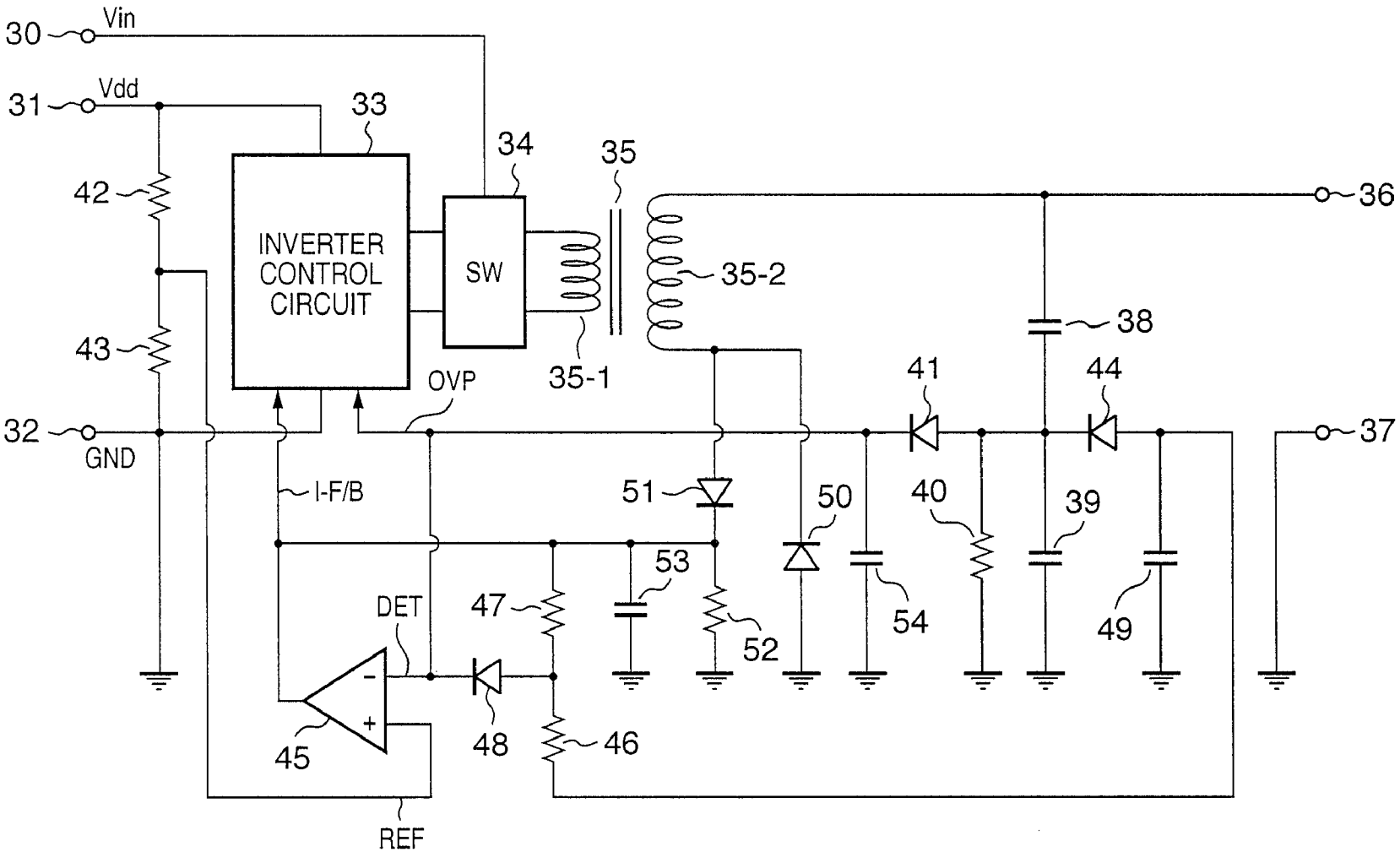
FIG. 3 is a circuit diagram of the second embodiment of the discharge lamp drive control circuit according to the present invention.

FIG. 3 shows the second embodiment of the present invention in which a driving transformer detects a voltage corresponding to an electric current flowing through a discharge lamp. Referring to FIG. 3, an inverter comprising an inverter control circuit 33, a switching circuit 34 including a semiconductor switching element, and a driving transformer 35 converts a DC power supply voltage Vin applied between terminals 30 and 32 into a high-frequency driving voltage. The converted high-frequency driving voltage is applied to a discharge lamp (not shown) connected to a high voltage side output terminal 36 and low voltage side output terminal 37, thereby turning on the discharge lamp. Note that the terminal 32 is a ground terminal and receives a ground voltage GND.

A terminal 31 applies a DC operating voltage Vdd for operating the inverter control circuit 33. The inverter control circuit 33 generates a switching control signal for controlling the switching circuit 34. The switching circuit 34 supplies an alternating current to a primary coil 35-1 of the driving transformer 35, thereby generating a high-frequency driving signal in a secondary coil 35-2 of the driving transformer 35. This turns on the discharge lamp connected to the high voltage side output terminal 36 and low voltage side output terminal 37.

Capacitors 38 and 39 for high voltage detection are connected in series between the high voltage side of the secondary coil 35-2 of the driving transformer 35 and the ground voltage GND. A resistor 40 is connected in parallel to the capacitor 39. The connection midpoint of the capacitors 38 and 39 for high voltage detection is connected to the anode electrode of a diode 41 that is comprised in a circuit for detecting the positive change of voltage at this midpoint. A capacitor 54 is connected to the cathode electrode of the diode 41. A positive change detection voltage obtained in this cathode electrode is applied to the inverted input terminal of a comparison circuit 45, and also applied to the OVP terminal of the inverter control circuit 33.

A reference voltage REF is applied to the non-inverted input terminal of the comparison circuit 45. The reference voltage REF is applied from the connection midpoint of a pair of resistors 42 and 43 inserted between the terminals 31 and 32. The comparison circuit 45 supplies the output to the I-F/B terminal of the inverter control circuit 33, thereby controlling the operation of the inverter.

The connection midpoint of the capacitors 38 and 39 for high voltage detection is further connected to the cathode electrode of a diode 44 that is comprised in a circuit for detecting the negative change of voltage at this midpoint, and the anode electrode of the diode 44 is connected to the anode electrode of a diode 48 via the connection midpoint of resistors 46 and 47. Since the cathode electrode of the diode 48 is connected to the inverted input terminal of the comparison circuit 45, a negative change detection voltage obtained in the anode electrode of the diode 44 is added via the resistor 46 and diode 48 to the positive change detection voltage, and the added voltage is applied as a detection signal DET to the inverting input terminal of the comparison circuit 45.

The low voltage side of the secondary coil 35-2 of the driving transformer 35 is grounded via a series circuit of a diode 51 and resistor 52. A voltage corresponding to the driving current of the discharge lamp is detected from this connection midpoint and added to the output from the comparison circuit 45, and the added output is applied to the I-F/B terminal of the inverter control circuit 33, thereby controlling lighting of the discharge lamp in a normal operation. Note that the low voltage side of the secondary coil 35-2 of the driving transformer 35 is further connected to the cathode electrode of a diode 50, and the anode electrode of the diode 50 is set at the ground voltage GND. Also, a capacitor 53 is connected in parallel to the resistor 52.

The operation of the second embodiment shown in FIG. 3 is basically almost identical to that of the first embodiment shown in FIG. 1, so a repetitive explanation will be omitted. The positive change detection voltage and negative change detection voltage at the connection midpoint of the capacitors 38 and 39 for high voltage detection are added, and the added voltage is applied to the inverted input terminal of the comparison circuit 45. Since the output from the comparison circuit 45 controls the inverter control circuit 33, it is possible to control load short circuit abnormality and load open circuit abnormality by using only one comparison circuit 45.

The second embodiment shown in FIG. 3 is also an embodiment using the comparison circuit 45 in addition to the inverter control circuit 33. Depending on the internal circuit configuration of the inverter control circuit 33, however, a comparison circuit arranged in the inverter control circuit 33 as an internal circuit of the I-F/B terminal of the inverter control circuit 33 may also be used as the comparison circuit 45.

Third Embodiment

Figure 4:
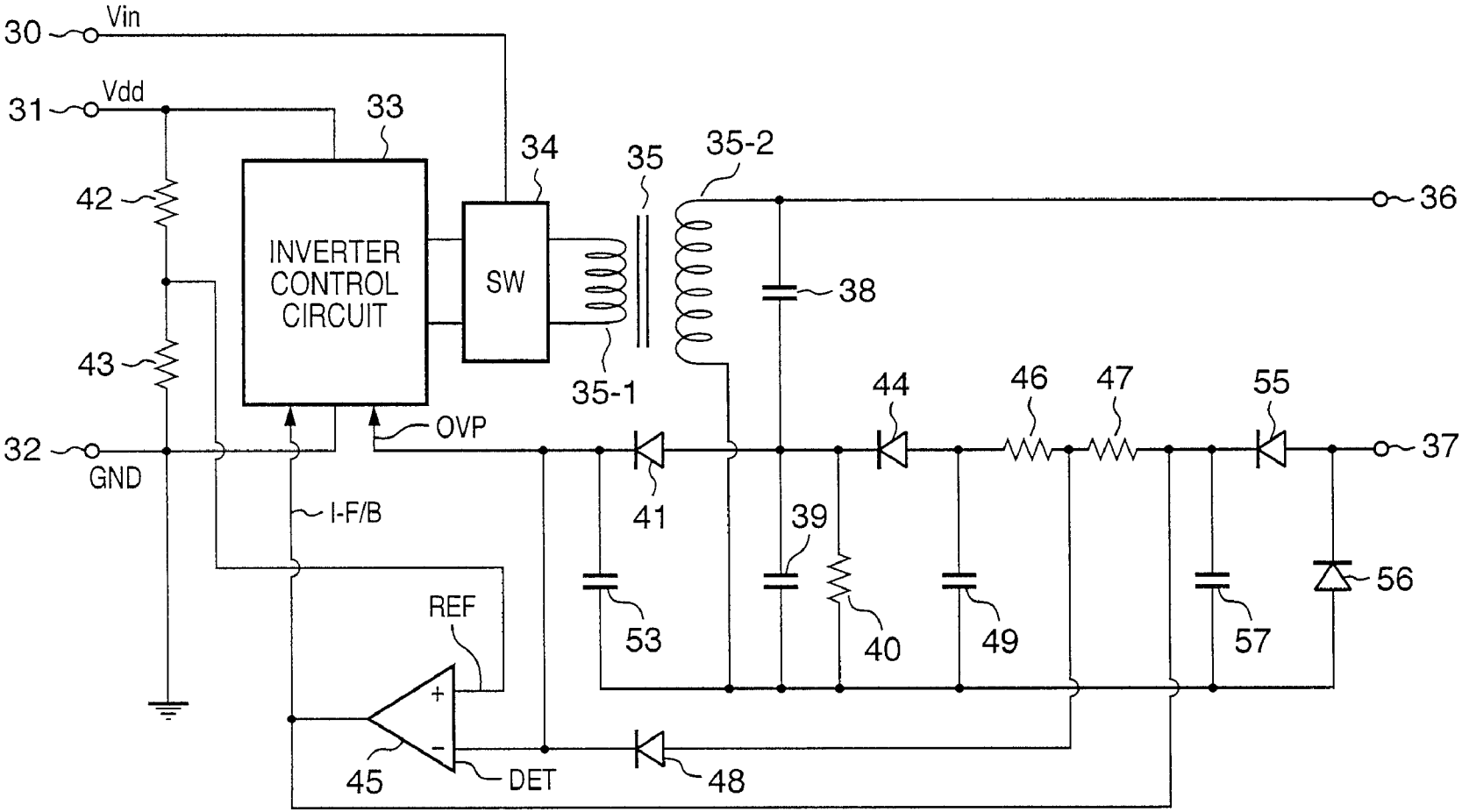
FIG. 4 is a circuit diagram of the third embodiment of the discharge lamp drive control circuit according to the present invention.

FIG. 4 shows the third embodiment of the present invention. The third embodiment is a modification of the second embodiment of the present invention explained with reference to FIG. 3, so the same reference numerals as in the second embodiment of the present invention denote the same parts, and a repetitive explanation will be omitted. In the second embodiment of the present invention shown in FIG. 3, the voltage corresponding to the driving current of the discharge lamp is detected from the low voltage side of the secondary coil of the driving transformer 35 by using the diode 51 and resistor 52.

By contrast, in the third embodiment shown in FIG. 4, diodes 55 and 56 and a capacitor 57 are arranged for a low voltage side output terminal 37 connected to a discharge lamp, thereby detecting the voltage corresponding to the driving current of the discharge lamp. The circuit configuration of this detection method is the same as that of the detection method in the first embodiment of the present invention shown in FIG. 1. A positive change detection voltage and negative change detection voltage at the connection midpoint of capacitors 38 and 39 for high voltage detection are added, the added voltage is applied to the inverted input terminal of a comparison circuit 45, and the output from the comparison circuit 45 controls an inverter control circuit 33, in the third embodiment of the present invention shown in FIG. 4 as well. Accordingly, the single control circuit 45 can control load short circuit abnormality and load open circuit abnormality.

Also, depending on the internal circuit configuration of the inverter control circuit 33, a comparison circuit arranged in the inverter control circuit 33 as an internal circuit of the I-F/B terminal of the inverter control circuit 33 may also be used as the comparison circuit 45, in the third embodiment shown in FIG. 4 as well.

Fourth Embodiment

Figure 5:
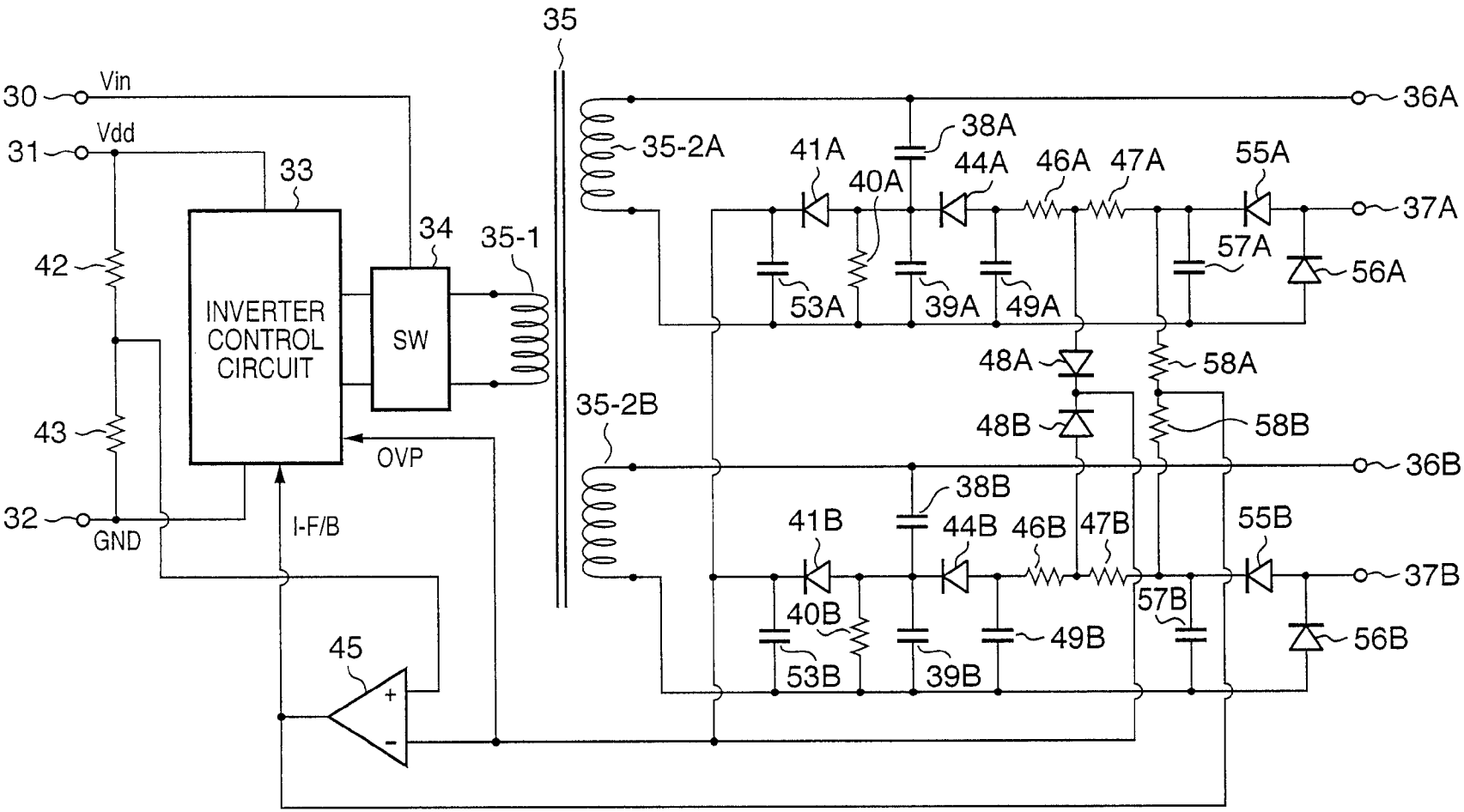
FIG. 5 is a circuit diagram of the fourth embodiment of the discharge lamp drive control circuit according to the present invention, and shows an example in which two discharge lamps are controlled.

FIG. 5 shows the fourth embodiment of the present invention. The fourth embodiment is a modification of the third embodiment of the present invention explained with reference to FIG. 4, so the same reference numerals as in the third embodiment of the present invention denote the same parts, and a repetitive explanation will be omitted. Since the fourth embodiment includes two circuits, however, symbols A and B are attached to the reference numerals to distinguish between the circuits. Also, the fourth embodiment uses a driving transformer having two secondary coils 35-2A and 35-2B as a driving transformer 35.

In the fourth embodiment shown in FIG. 5, diodes 55A and 56A and a capacitor 57A are arranged for a low voltage side output terminal 37A connected to a discharge lamp. Likewise, diodes 55B and 56B and a capacitor 57B are arranged for a low voltage side output terminal 37B. Resistors 58A and 58B add these outputs, the added output is also added to the output from a comparison circuit 45, and the added output is supplied to the I-F/B terminal of an inverter control circuit 33.

The operation of the fourth embodiment shown in FIG. 5 is basically the same as those of the first and third embodiments respectively explained with reference to FIGS. 1 and 4, so a repetitive explanation will be omitted. In the fourth embodiment, as in the first embodiment of the present invention shown in FIG. 1, the single comparison circuit 45 can control load short circuit abnormality and load open circuit abnormality of the two driving circuits.

In addition, depending on the internal circuit configuration of the inverter control circuit 33, a comparison circuit arranged in the inverter control circuit 33 as an internal circuit of the I-F/B terminal of the inverter control circuit 33 may also be used as the comparison circuit 45, in the embodiment shown in FIG. 5 as well.

Fifth Embodiment

Figure 6:
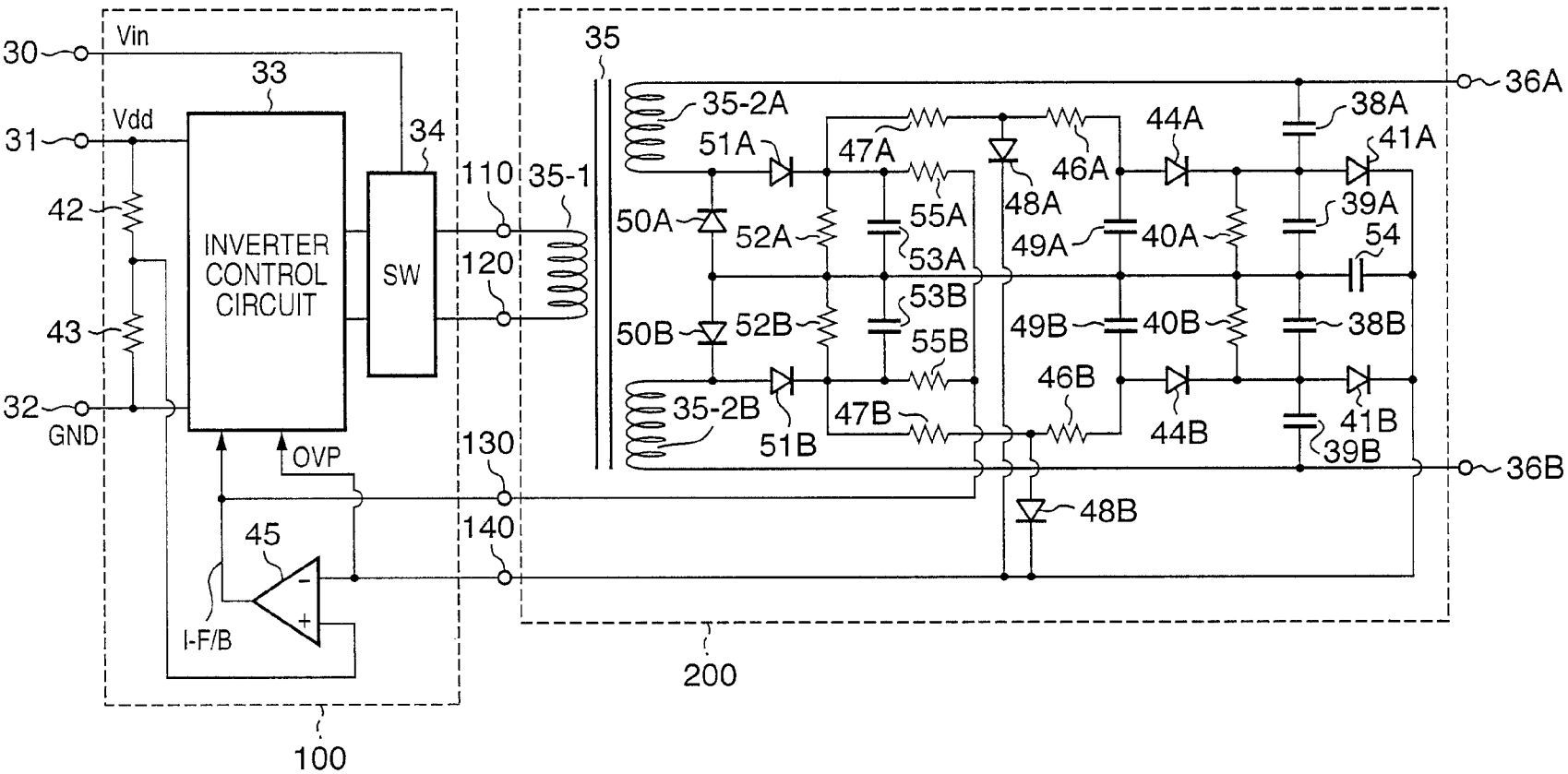
FIG. 6 is a circuit diagram of the fifth embodiment of the discharge lamp drive control circuit according to the present invention.

FIG. 6 shows the fifth embodiment of the present invention. The fifth embodiment is a modification of the second embodiment shown in FIG. 3, so the same reference numerals as in the second embodiment of the present invention denote the same parts, and a repetitive explanation will be omitted. Since the fifth embodiment includes two circuit systems, however, symbols A and B are attached to the reference numerals to distinguish between the circuits. Also, the fifth embodiment uses a driving transformer having two secondary coils 35-2A and 35-2B as a driving transformer 35.

In the fifth embodiment shown in FIG. 6, a diode 51A detects an electric current flowing through the secondary coil 35-2A of the driving transformer 35, and a diode 51B detects an electric current flowing through the secondary coil 35-2B. Resistors 55A and 55B add detection signals of the detected electric currents, and apply the added signal to the I-F/B terminal of an inverter control circuit 33. A positive change detection voltage of the secondary coil 35-2A is obtained via a diode 41A, and a positive change detection voltage of the secondary coil 35-2B is obtained via a diode 41B. These two detection voltages are added, and the added voltage is applied to the inverted input terminal of a comparison circuit 45, and also input to the OVP terminal of the inverter control circuit 33.

A negative change detection voltage of the secondary coil 35-2A is obtained via a diode 44A, and a negative change detection voltage of the secondary coil 35-2B is obtained via a diode 44B. These detection voltages are added via a resistor 46A, diode 48A, resistor 46B, and diode 48B, and the added voltage is further added to the positive change detection voltage. The obtained voltage is applied to the inverting input terminal of the comparison circuit 45, and also input to the OVP terminal of the inverter control circuit 33. A discharge lamp is connected between terminals 36A and 36B.

The rest of the operation is basically the same as that of the second embodiment shown in FIG. 3, so a repetitive explanation will be omitted. Also, depending on the internal circuit configuration of the inverter control circuit 33, a comparison circuit arranged in the inverter control circuit 33 as an internal circuit of the I-F/B terminal of the inverter control circuit 33 may also be used as a comparison circuit 45, in the fifth embodiment shown in FIG. 6 as well.

Furthermore, in the fifth embodiment shown in FIG. 6, a discharge lamp drive control circuit is divided into an inverter driving circuit 100 and discharge lamp control circuit 200, and these circuits are connected by using terminals 110,120, 130, and 140. The inverter driving circuit 100 basically includes the inverter control circuit 33, a switching circuit 34, and the comparison circuit 45. The discharge lamp control circuit 200 includes a driving current detecting circuit comprising the driving transformer 35, the diode 51A, a resistor 52A, the diode 51B, and a resistor 52B. The discharge lamp control circuit 200 basically further includes a positive change voltage detecting circuit comprising the diodes 41A and 41B, and a negative change voltage detecting circuit comprising the diodes 44A and 44B.

When controlling driving of a plurality of discharge lamps by the discharge lamp drive control circuit, a plurality of discharge lamp control circuits 200 are connected in parallel to the terminals 110,120,130, and 140 with respect to one inverter driving circuit 100. This makes it possible to simultaneously control the plurality of discharge lamp control circuits 200.

This concept is applicable not only to the fifth embodiment shown in FIG. 6 but also to the first to fourth embodiments.

The present invention is not limited to the above embodiments and can be variously changed and modified without departing from the spirit and scope of the invention. Therefore, to apprise the public of the scope of the present invention, the following claims are made.

What is claimed is:

1. A discharge lamp drive control circuit which turns on a discharge lamp by applying, to the discharge lamp, a high-frequency driving voltage generated in a secondary coil of a driving transformer comprised in an inverter, comprising:

an inverter control circuit;

a positive change voltage detecting circuit which detects a positive change of voltage generated in the secondary coil of said driving transformer;

a negative change voltage circuit which detects a negative change of voltage generated in the secondary coil of said driving transformer; and a comparison circuit connected to said inverter control circuit, wherein outputs from said positive change voltage detecting circuit and said negative change voltage detecting circuit are added to generate an added output, the added output is supplied to said comparison circuit and compared with a reference voltage, and said comparison circuit supplies an abnormal operation control signal to said inverter control circuit when an abnormal operation occurs.

2. A discharge lamp drive control circuit according to claim 1, wherein said comparison circuit comprises a comparator, and an output from said comparator is connected as an F/B loop to said inverter control circuit.

3. A discharge lamp drive control circuit according to claim 1, wherein each of said positive change voltage detecting circuit and said negative change voltage detecting circuit is connected to a position at which a voltage is generated by dividing the high-frequency driving voltage by capacitors for detecting an abnormal operation.

4. A discharge lamp drive control circuit according to claim 3, wherein said comparison circuit comprises a comparator, and an output from said comparator is connected as an F/B loop to said inverter control circuit.

5. A multi-lamp-type discharge lamp drive control circuit which has a plurality of driving transformers comprised in an inverter, and turns on discharge lamps by applying, to the discharge lamps, high-frequency driving voltages generated in secondary coils of said driving transformers, comprising:

an inverter control circuit;

a plurality of positive change voltage detecting circuits which detect positive changes of voltages generated in the secondary coils of said driving transformers;

a plurality of negative change voltage detecting circuits which detect negative changes of voltages generated in the secondary coils of said driving transformers; and a comparison circuit connected to said inverter control circuit, wherein outputs from said negative change voltage detecting circuits are added via an OR circuit to outputs from said positive change voltage detecting circuits to generate an added output, the added output is supplied to said comparison circuit and compared with a reference voltage, and said comparison circuit supplies an abnormal operation control signal to said inverter control circuit when an abnormal operation occurs.

6. A discharge lamp drive control circuit according to claim 5, wherein a comparison circuit included in said inverter control circuit is used as said comparison circuit.

7. A discharge lamp drive control circuit according to claim 5, wherein each of said positive change voltage detecting circuits and said negative change voltage detecting circuits is connected to a position at which a voltage is generated by dividing the high-frequency driving voltage by capacitors for detecting an abnormal operation.

8. A discharge lamp drive control circuit according to claim 5, wherein said comparison circuit comprises a comparator, and an output from said comparator is connected as an F/B loop to said inverter control circuit.

* * * * *